US008012661B2

(12) United States Patent
Udo et al.

(10) Patent No.: US 8,012,661 B2
(45) Date of Patent: Sep. 6, 2011

(54) METHOD FOR PRODUCING DEVELOPING AGENT

(75) Inventors: Motonari Udo, Mishima (JP); Takayasu Aoki, Mishima (JP); Takashi Urabe, Sunto-gun (JP); Tsuyoshi Itou, Izunokuni (JP); Yasuhito Noda, Mishima (JP); Satoshi Araki, Izunokuni (JP); Masahiro Ikuta, Mishima (JP); Takafumi Hara, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 500 days.

(21) Appl. No.: 12/260,183

(22) Filed: Oct. 29, 2008

(65) Prior Publication Data

US 2009/0130589 A1 May 21, 2009

Related U.S. Application Data

(60) Provisional application No. 60/988,351, filed on Nov. 15, 2007.

(51) Int. Cl.
*G03G 9/093* (2006.01)

(52) U.S. Cl. ..... 430/137.11; 430/137.14; 430/137.18; 430/137.19; 430/137.21

(58) Field of Classification Search ..... 430/137.11, 430/137.14, 137.18, 137.19, 137.21
See application file for complete search history.

(56) References Cited

U.S. PATENT DOCUMENTS

| | | | | |
|---|---|---|---|---|
| 5,753,396 | A * | 5/1998 | Nakamura et al. | 430/101 |
| 7,794,912 | B2 * | 9/2010 | Urabe et al. | 430/137.13 |
| 2007/0281240 | A1 | 12/2007 | Urabe et al. | |

FOREIGN PATENT DOCUMENTS

| | | |
|---|---|---|
| JP | 63-282752 | 11/1988 |
| JP | 06-250439 | 9/1994 |
| JP | 09-311502 | 12/1997 |
| JP | 2007-323071 | 12/2007 |

* cited by examiner

*Primary Examiner* — Hoa V Le
(74) *Attorney, Agent, or Firm* — Turocy & Watson, LLP

(57) ABSTRACT

A method for producing a developing agent contains mechanically shearing a mixture containing a polyester resin, a colorant and a releasing agent to form first fine particles, aggregating the first fine particles to form aggregated particles as a core, aggregating second fine particles containing a polyester resin onto the core to form a shell.

7 Claims, 1 Drawing Sheet

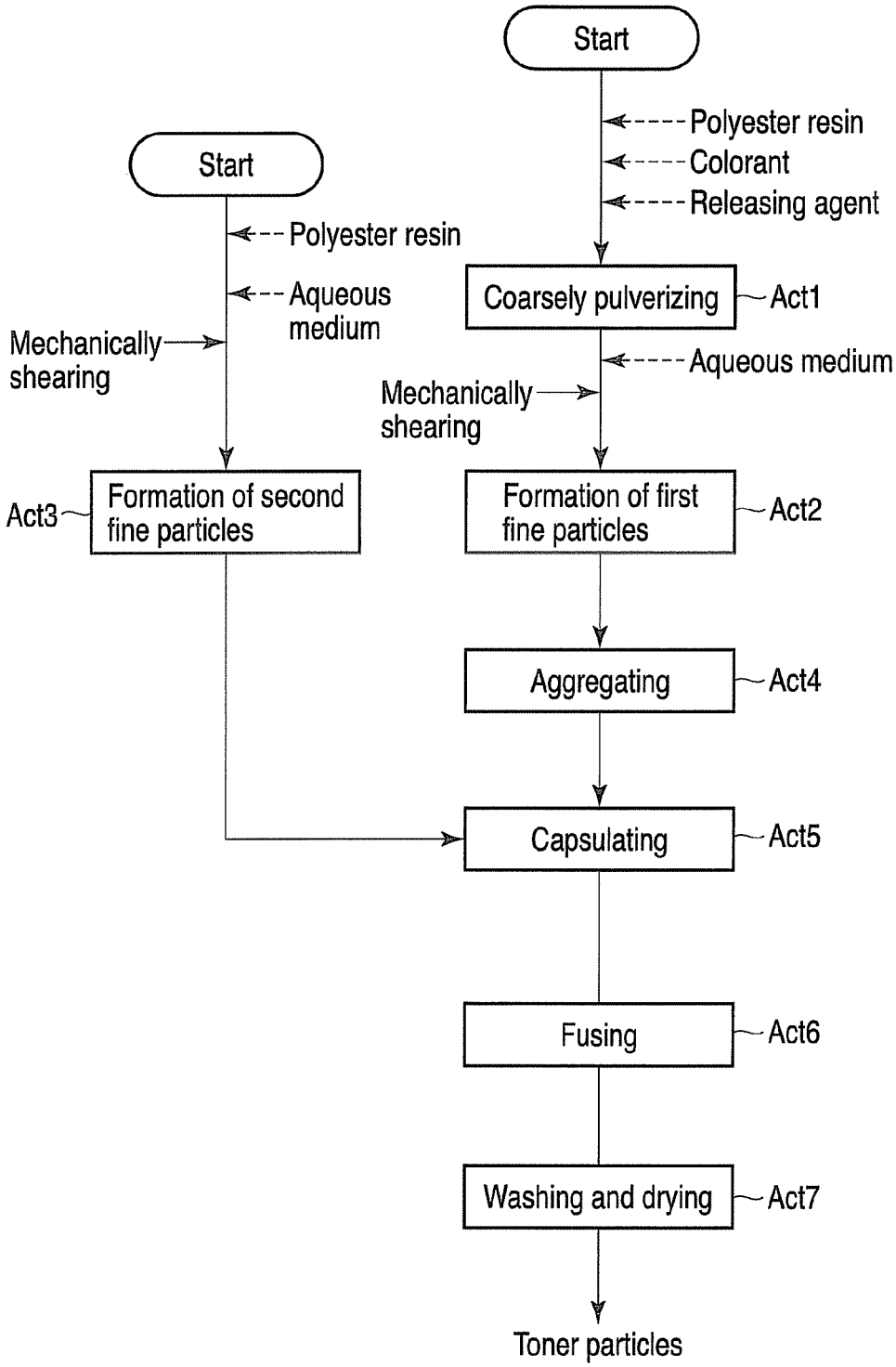
FIGURE

METHOD FOR PRODUCING DEVELOPING AGENT

CROSS-REFERENCE TO THE RELATED APPLICATION

This application claims the benefit of U.S. Provisional Application No. 60/988,351, filed Nov. 15, 2007.

TECHNICAL FIELD

The present invention relates to a method for producing a developing agent that develops an electrostatic charge image and a magnetic latent image in an electrophotographic process, an electrostatic printing process, a magnetic recording process and the like, and more particularly, it relates to a method for producing a capsulated developing agent.

BACKGROUND

In an electrophotographic process, an electric latent image is formed on an image carrying member, the latent image is developed with a toner, and the toner image is transferred to a transfer material, such as paper, and then fixed with such a measure as heating and pressurizing. The toners used include not only a conventional monochrome black toner but also toners of plural colors for forming a full color image.

The toner is used as a two-component developing agent used after mixing with carrier particles, and a one-component toner, which is used as a magnetic toner or a non-magnetic toner. The toner is generally produced by a kneading and pulverization method. In the kneading and pulverization method, a binder resin, a pigment, a releasing agent, such as wax, a charge controlling agent and the like are melt-kneaded to form a mixture, and after cooling, the mixture is finely pulverized and classified to produce target toner particles. Inorganic and/or organic fine particles are added to the surface of the toner particles produced by the kneading and pulverization method according to purposes, thereby providing a toner.

The toner particles produced by the kneading and pulverization method generally have an irregular shape and a heterogeneous composition on the surface thereof. The shape and the surface composition of the toner particles finely vary depending on the pulverizing property of the raw materials and the conditions upon pulverizing, and it is difficult to control the shape intentionally.

When a material having high pulverizing property is used, in particular, the material is pulverized further finely to change the shape thereof through various kinds of stress in a developing device. As a result, in a two-component developing agent, fine particles of the toner are fixed to the carrier surface to accelerate deterioration in charging property of the developing agent, and in a one-component toner, the particle size distribution of the toner is broadened, whereby fine particles of the toner are scattered, and the developing property is lowered due to the change in toner shape, which deteriorate the image quality.

When the toner contains a releasing agent, such as wax, the releasing agent may appear on the surface of the toner since pulverization is liable to occur at an interface between the binder resin and the releasing agent. A toner having a combination of a resin that is hard to be pulverized due to high elastic modulus and brittle wax, such as polyethylene, often suffers exposure of the polyethylene on the surface thereof. The toner is advantageous in releasing property upon fixing and cleaning property of an untransferred toner from a photoreceptor, but the polyethylene on the toner surface may be released from the toner by a mechanical force, such as a shearing force in a developing device, and may migrate to a developing roller, an image carrying member, a carrier and the like. Accordingly, the developing roller, the image carrying member, the carrier and the like are liable to be contaminated with wax, which may bring about poor reliability of a developing agent.

Under the circumstances, in recent years, JP-A-63-282752 and JP-A-6-250439 propose an emulsion polymerization and aggregation method as a production method of a toner, in which the shape and the surface composition of the toner are intentionally controlled.

In the emulsion polymerization and aggregation method, a resin dispersion liquid is produced by emulsion polymerization, and separately, a colorant dispersion liquid is produced by dispersing a colorant in a solvent. The dispersion liquids are mixed to form aggregated particles having diameter corresponding to the toner diameter, which are fused by heating to provide toner particles. In the emulsion polymerization and aggregation method, the shape of the toner can be arbitrarily controlled from an irregular shape to a spherical shape by selecting the heating temperature conditions.

In the emulsion polymerization and aggregation method, toner particles are obtained by aggregating and fusing at least a dispersion liquid of resin fine particles and a dispersion liquid of a colorant under prescribed conditions. However, the resin that can be applied to the emulsion polymerization and aggregation method is limited in species, i.e., a styrene-acrylic copolymer can be favorably applied, but a polyester resin, which is known to have good fixing property, cannot be applied.

As a production method of a toner using a polyester resin, on the other hand, a phase inversion emulsification method is known, in which a pigment dispersion liquid and the like are added to a solution of a polyester resin dissolved in an organic solvent, to which water is then added, but the organic solvent is necessarily removed and recovered. JP-A-9-311502 proposes a method of producing fine particles by mechanical shearing in an aqueous solvent without the use of an organic solvent, but in this method, a resin and the like in a molten state are necessarily fed to an agitating device, which provides difficulty in handling. Furthermore, the method is low in degree of freedom on controlling the shape, and the shape of the toner cannot be arbitrarily controlled from an irregular shape to a spherical shape.

As disclosed, for example, in JP-A-2007-323071, when a mixture containing a binder resin and a colorant with a releasing agent added thereto is finely dispersed into particles in an aqueous medium, the releasing agent and the colorant are present on the surface of the toner, and thus the releasing agent and the colorant on the toner surface may be released from the toner by a mechanical force, such as a shearing force, in the developing device to migrate easily to the developing roller, the image carrying member, the carrier and the like although they are advantageous in releasing property upon fixing and cleaning property of an untransferred toner from the photoreceptor. Accordingly, the developing roller, the image carrying member, the carrier and the like are liable to be contaminated, which may bring about deterioration in image quality.

SUMMARY

An object of the invention is to provide a developing agent that may not cause contamination of a developing roller, an image carrying member, a carrier and the like with a releasing agent and a colorant, and that is improved in stability to environments.

The method for producing a developing agent of the invention contains:

melt-kneading a mixture containing a polyester resin, a colorant and a releasing agent to form a kneaded product, coarsely pulverizing the kneaded product to form a coarsely granulated mixture;

mixing the coarsely granulated mixture with an aqueous medium to form a mixed liquid, mechanically shearing the mixed liquid to granulate finely the coarsely granulated mixture, thereby forming a first fine particle dispersion liquid;

aggregating first fine particles in the first fine particle dispersion liquid to form aggregated particles;

mixing coarse particles containing at least a polyester resin with an aqueous medium to form a mixed liquid, mechanically shearing the mixed liquid to granulate finely the coarse particles, thereby forming a second fine particle dispersion liquid; and mixing the second fine particle dispersion liquid with the aggregated particles to aggregate second fine particles in the second fine particle dispersion liquid onto a surface of the aggregated particles, thereby forming capsulated toner particles containing the aggregated particles as a core and the second fine particles as a shell.

DESCRIPTION OF THE DRAWINGS

The single FIGURE is a flow chart showing an example of a method for producing a developing agent according to the invention.

DETAILED DESCRIPTION

The method for producing a developing agent according to the invention may include the following features.

As a first stage, a mixture containing a polyester resin, a colorant and a releasing agent is melt-kneaded and coarsely pulverized to form a coarsely granulated mixture. The coarsely granulated mixture is mixed with an aqueous medium to form a dispersion liquid, and the dispersion liquid is mechanically sheared to granulate finely the coarsely granulated mixture, thereby forming a first fine particle dispersion liquid. The first fine particles in the first fine particle dispersion liquid are aggregated to form aggregated particles.

As a second stage, coarse particles containing at least a polyester resin is mixed with an aqueous medium to form a dispersion liquid, and the dispersion liquid is mechanically sheared to granulate finely the coarse particles, thereby forming a second fine particle dispersion liquid.

As a third stage, the dispersion liquid of the aggregated particles containing the first fine particles and the second fine particle dispersion liquid to aggregate second fine particles in the second fine particle dispersion liquid onto the surface of the aggregated particles, thereby capsulating the aggregated particles as a core with the second fine particles as a shell.

According to the method of the invention, the first fine particles constituting the aggregated particles forming the core and the second fine particles forming the shell each are produced separately by mixing the raw materials therefor in an aqueous medium separately, and then mechanically shearing separately, whereby the materials are finely divided and sufficiently granulated. According to the method, a capsulated toner can be produced without the use of an organic solvent, and a capsulated toner suffering less fluctuation in surface composition and exhibiting sufficient fixing property and transferring property can be obtained. In the invention, the fine particles are not used as they are for capsulation, but the fine particles once produced are aggregated to form aggregated particles having an intended particle diameter. Accordingly, the particle size distribution of the aggregated particles may be homogeneous. In the invention, the second fine particles, which have a smaller size than the size of the aggregated particles, are aggregated on the surface of the aggregated particles to form a coated layer of the second fine particles for capsulation. The homogeneous particle diameter of the aggregated particles may make the particle diameter of the capsulated toner homogeneous.

The use of the capsulated toner can provide an image with good quality.

According to the invention, furthermore, the aggregated particles, which contain such materials as a colorant and a releasing agent that are liable to contaminate a developing roller, an image carrying member, a carrier and the like, are used as a core, and are capsulated with the second fine particles containing a binder resin as a shell, whereby contamination by the developing agent is suppressed from occurring to enhance the environmental stability.

The invention will be described in more detail with reference to the FIGURE.

FIG. 1 is a flow chart showing an example of the method for producing a developing agent according to the invention.

As shown in the FIGURE, in the method for producing a developing agent according to the invention, a mixture containing a binder resin, a colorant and a releasing agent is prepared and melt-kneaded, for example, with PCM at 100° C., and then the mixture is dried and coarsely pulverized to prepare a coarsely granulated mixture (Act 1).

The coarsely granulated mixture preferably has a volume average particle diameter of from 0.05 to 10 mm.

When the volume average particle diameter is less than 0.03 mm, strong agitation may be required for dispersing the mixture in an aqueous medium, and bubbles caused by agitation may deteriorate dispersion of the mixture, and when it exceeds 10 mm, the particle diameter may be larger than the gap provided in the shearing part of the mechanically shearing device, which may cause clogging of the particles in the shearing part and formation of particles that are heterogeneous in composition and particle diameter due to difference in energy applied to the inner part and the outer part of the mixture.

The coarsely granulated mixture more preferably has a volume average particle diameter of from 0.1 to 5 mm.

The coarsely granulated mixture is then dispersed in an aqueous medium to form a dispersion liquid of the coarsely granulated mixture.

In the process for producing the dispersion liquid of the coarsely granulated mixture, the aqueous medium may arbitrarily contain at least one of a surfactant and a pH controlling agent.

The addition of a surfactant facilitates dispersion of the mixture in the aqueous medium by the function of the surfactant adsorbed on the surface of the mixture. The addition of a pH controlling agent enhances the self-dispersion property of the mixture by increasing the dissociation degree of the dissociative functional groups on the surface of the fine particles and by increasing the polarity thereon.

Subsequently, the dispersion liquid is mechanically sheared to granulate finely the coarsely granulated mixture, thereby forming first fine particles (Act 2).

The first fine particles preferably have a volume average particle diameter of from 50 to 1,000 nm.

Coarse particles containing at least a binder resin is then mixed with an aqueous medium to form a dispersion liquid, and the dispersion liquid is mechanically sheared to granulate finely the coarse particles, thereby forming second fine particles (Act 3).

The second fine particles preferably have a volume average particle diameter of from 50 to 200 nm. When the volume average particle diameter is 50 nm or less, the viscosity of the slurry upon aggregation may be increased to impair the agitation operation. When it exceeds 500 nm, it may be difficult to adsorb the second fine particles to the core through heterogeneous aggregation.

In the invention, a polyester resin is used as the binder resin. The polyester resin may be used solely or as a mixture with other resins.

The coarse particles may be obtained, for example, by melt-kneading and then coarsely pulverizing the materials containing the binder resin, or by granulating the material containing the binder resin.

The coarse particles preferably have a volume average particle diameter of from 0.03 to 10 mm.

When the volume average particle diameter is less than 0.03 mm, strong agitation may be required for dispersing the coarse particles in an aqueous medium, and bubbles caused by agitation may deteriorate dispersion of the coarse particles, and when it exceeds 10 mm, the particle diameter may be larger than the gap provided in the shearing part of the mechanically shearing device, which may cause clogging of the particles in the shearing part and formation of particles that are heterogeneous in composition and particle diameter due to difference in energy applied to the inner part and the outer part of the coarse particles.

The coarse particles more preferably have a volume average particle diameter of from 0.05 to 5 mm.

In the process for producing the dispersion liquid of the coarse particles containing the binder resin, the aqueous medium may arbitrarily contain at least one of a surfactant and a pH controlling agent.

The addition of a surfactant facilitates dispersion of the coarse particles in the aqueous medium by the function of the surfactant adsorbed on the surface of the coarse particles. The addition of a pH controlling agent enhances the self-dispersion property of the coarse particles by increasing the dissociation degree of the dissociative functional groups on the surface of the binder resin and by increasing the polarity thereon.

The dispersion liquid may be mechanically sheared under heating to a temperature equal to or higher than the glass transition temperature (Tg) of the binder resin.

Upon mechanically shearing the dispersion liquid in the aqueous medium at a temperature equal to or higher than Tg of the binder resin, the viscous nature of the binder resin in the form of the coarse particles, which can be finely divided for granulation.

In the invention, the size of the resulting fine particles can be controlled by adjusting the processing temperature and the processing time upon mechanically shearing, the number of passes of a high-pressure microparticulation device, the rotation number of an agitation microparticulation device, the ultrasonic intensity of an ultrasonic microparticulation device, and the like.

The dispersion liquid of the first fine particles and an aggregating agent are then charged in a vessel.

The fine particles are aggregated until reaching an intended size to form aggregated particles (Act 4).

An aggregating agent may be added to the dispersion liquid for forming the aggregated particles.

Upon forming the aggregated particles, plural fine particles can be aggregated by such a process as addition of an aggregating agent, such as a pH controlling agent, a surfactant, a water soluble salt and an organic solvent, or control of the temperature. The shape of the aggregated particles thus obtained can be controlled by adjusting the process.

The aggregated particles are then mixed with the dispersion liquid of the fine particles containing the binder resin having a size, which is different from the aggregated particles, to form capsulated particles (Act 5).

For capsulating the aggregated particles with the second fine particles, such a process as addition of an aggregating agent, such as a pH controlling agent, a surfactant, a water soluble salt and an organic solvent, or control of the temperature may be used.

For stabilizing the aggregated particles, the dispersion liquid thereof may be fused, for example, by heating to a temperature higher by from 5 to 80° C. than the glass transition temperature of the binder resin.

The aggregated particles preferably have a volume average particle diameter of from 1 to 15 μm.

The aggregated particles preferably have a circularity of from 0.8 to 1.0.

After forming the aggregated particles, the dispersion liquid thereof may be cooled, for example, to from 5° C. to the glass transition temperature or lower, and then washed, for example, with a filter press, followed by drying (Act 7), thereby providing capsulated toner particles.

As the binder resin used in the invention, a polyester resin excellent in fixing property and transparency is used. Other resins may be used in combination as the binder resin. Examples thereof include a styrene resin, such as polystyrene, a styrene-butadiene copolymer and a styrene-acrylic copolymer, an ethylene resin, such as polyethylene, an ethylene-vinyl acetate copolymer, an ethylene-norbornene copolymer and an ethylene-vinyl alcohol copolymer, an acrylic resin, a phenol resin, an epoxy resin, an allyl phthalate resin, a polyamide resin and a maleic acid resin. These resins may be used in combination of two or more of them.

As the polyester resin used as the core, low molecular weight polyester having a weight average molecular weight of from 5,000 to 20,000 and high molecular weight polyester having a weight average molecular weight of from 30,000 to 60,000 may be used in combination.

The combination use of two kinds of polyester advantageously enhances the non-offset region to improve the fixing property.

In alternative, crystalline polyester having a softening point at 100° C. may be used as a core.

The use of crystalline polyester advantageously provides sharp-melt property to improve the fixing property.

The binder resin preferably has an acid value of 1 or more.

Examples of the colorant used in the invention include carbon black, and an organic and inorganic pigment and an organic and inorganic dye. Examples of the carbon black include acetylene black, furnace black, thermal black, channel black and Ketjen black. Examples of the yellow pigment include C.I. Pigment Yellow 1, 2, 3, 4, 5, 6, 7, 10, 11, 12, 13, 14, 15, 16, 17, 23, 65, 73, 74, 81, 83, 93, 95, 97, 98, 109, 117, 120, 137, 138, 139, 147, 151, 154, 167, 173, 180, 181, 183 and 185, and C.I. Vat Yellow 1, 3 and 20. These pigments may be used solely or as a mixture. Examples of the magenta pigment include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 146, 150, 163, 184, 185, 202, 206, 207, 209 and 238, C.I. Pigment Violet 19, and C.I. Vat Red 1, 2, 10, 13, 15, 23, 29 and 35. These pigments may be used solely or as a mixture. Examples of the cyan pigment include C.I. Pigment Blue 2, 3, 15, 16 and 17, C.I. Vat Blue 6 and C.I. Acid Blue 45. These pigments may be used solely or as a mixture.

Wax may be added to the kneaded product for forming the core of the capsulated toner.

Examples of the wax include aliphatic hydrocarbon wax, such as low molecular weight polyethylene, low molecular weight polypropylene, a polyolefin copolymer, polyolefin wax, microcrystalline wax, paraffin wax and Fischer-Tropsch wax, an oxidized product of aliphatic hydrocarbon wax, such as oxidized polyethylene wax, a block copolymer thereof, vegetable wax, such as candelilla wax, carnauba wax, haze wax, jojoba wax and rice wax, animal wax, such as bees wax, lanolin and whale wax, mineral wax, such as ozokerite, ceresin and petrolatum, wax mainly containing a fatty acid ester, such as montanate ester wax and castor wax, and a partially or wholly deoxidized product of a fatty acid ester, such as deoxidized carnauba wax. Examples of the wax also include a saturated linear fatty acid, such as palmitic acid, stearic acid, montanic acid and a long-chain alkylcarboxylic acid having a further longer alkyl group, an unsaturated fatty acid, such as brassidic acid, eleostearic acid and parinaric acid, a saturated alcohol, such as stearyl alcohol, eicosyl alcohol, behenyl alcohol, carbaubyl alcohol, ceryl alcohol, melissyl alcohol and a long-chain alkyl alcohol having a further longer alkyl group, a polyhydric alcohol, such as sorbitol, a fatty acid amide, such as linoleic acid amide, oleic acid amide and lauric acid amide, a saturated fatty acid bisamide, such as methylenebisstearic acid amide, ethylenebiscapric acid amide, ethylenebislauric acid amide and hexamethylenebisstearic acid amide, an unsaturated fatty acid amide, such as ethylenebisoleic acid amide, hexamethylenebisoleic acid amide, N,N'-dioleyladipic acid amide and N,N'-dioleylsebacic acid amide, an aromatic bisamide, such as m-xylenebisstearic acid amide and N,N'-distearylisophthalic acid amide, a fatty acid metallic salt (which is ordinarily referred to as a metallic soap), such as calcium stearate, calcium laurate, zinc stearate and magnesium stearate, wax produced by grafting a vinyl monomer, such as styrene and acrylic acid, to aliphatic hydrocarbon wax, a partially esterified product of a fatty acid and a polyhydric alcohol, such as behenic acid monoglyceride, and a methyl ester compound having a hydroxyl group obtained by hydrogenizing a vegetable oil.

A charge controlling agent may be added to the formulation of the capsulated toner of the invention, and examples thereof include a metal-containing azo compound, and those containing, as the metal, a complex compound or complex salt of iron, cobalt and chromium, and a mixture thereof, are preferred. Moreover, a metal-containing salicylic acid derivative may be used, and those containing, as the metal, a complex compound or complex salt of zirconium, zinc, chromium and boron, and a mixture thereof, are preferred.

The pH controlling agent capable of being used in the invention is preferably an amine compound. Examples of the amine compound include dimethylamine, trimethylamine, monoethylamine, diethylamine, triethylamine, propylamine, isopropylamine, dipropylamine, butylamine, isobutylamine, sec-butylamine, monoethanolamine, diethanolamine, triethanolamine, triisopropanolamine, isopropanolamine, dimethylethanolamine, diethylethanolamine, N-butyldiethanolamine, N,N-dimethyl-1,3-diaminopropane and N,N-diethyl-1,3-diaminopropane.

Examples of the surfactant capable of being used in the invention include an anionic surfactant, such as a sulfate ester type, a sulfonate type, a phosphate ester type and a soap type, a cationic surfactant, such as an amine salt type and a quaternary ammonium salt type, and a nonionic surfactant, such as a polyethylene glycol type, an alkylphenol ethyleneoxide type and a polyhydric alcohol type.

A high-pressure microparticulation device, an agitation microparticulation device, and an ultrasonic microparticulation device, and the like can be used as a mechanically shearing device in the invention.

Example of such mechanically shearing device include a medialess agitator, such as NANO3000 (available from Beryu Co., Ltd.), Ultra-Turrax (available from IKA Works Japan Co., Ltd.), T.K. Auto Homo Mixer (available from Primix Corporation), T.K. Pipeline Homo Mixer (available from Primix Corporation), T.K. Filmics (available from Primix Corporation), Cleamix (available from M-Technique Co., Ltd.), Clear SS5 (available from M-Technique Co., Ltd.), Cavitron (available from Eurotec, Ltd.) and Fine Flow Mill (available from Pacific Machinery & Engineering Co., Ltd.), and a media agitator, such as Viscomill (available from Aimex Co., Ltd.), Apexmill (available from Kotobuki Industries Co., Ltd.), Star Mill (available from Ashizawa Finetech, Ltd.), DCP Superflow (available from Nippon Eirich Co., Ltd.), MP Mill (available from Inoue Manufacturing Co., Ltd.), Spike Mill (available from Inoue Manufacturing Co., Ltd.), Mighty Mill (available from Inoue Manufacturing Co., Ltd.) and SC Mill (available from Mitsui Mining Co., Ltd.).

NANO3000 is also an example of a high-pressure microparticulation device, Nanomizer (available from Yshida kikai Co., ltd) and T.K. Auto Homo Mixer are examples of an agitation microparticulation device, Supersonic homogenizer (available from Nihon SiberHegner K.K.) is an example of an ultrasonic microparticulation device.

In the in Cleamix invention, a mixture or a kneaded product containing a resin and a pigment is formed into fine particles with a mechanically shearing device, and after forming the fine particles, they may be cooled to an intended temperature or may be set to a prescribed temperature, at which the fine particles are aggregated.

In the invention, for preparing the coarsely granulated mixture, the mixture containing a binder resin, a colorant and a releasing agent may be kneaded.

The kneading device used is not particularly limited if it is capable of melt-kneading, and examples thereof include a uniaxial extruder, a biaxial extruder, a pressure kneader, a Banbury mixer and a Brabender mixer. Specific examples thereof include FCM (available from Kobe Steel, Ltd.), NCM (available from Kobe Steel, Ltd.), LCM (available from Kobe Steel, Ltd.), ACM (available from Kobe Steel, Ltd.), KTX (available from Kobe Steel, Ltd.), GT (available from Ikegai Corporation), PCM (available from Ikegai Corporation), TEX (available from Japan Steel Works, Ltd.), TEM (available from Toshiba Machine Co., Ltd.), ZSK (available from Coperion Werner & Pfleiderer & Co. KG) and Kneadex (available from Mitsui Mining Co., Ltd.).

In the invention, a water soluble salt may be used upon aggregating the fine particles. Examples of the water soluble salt include a salt, such as sodium chloride, ammonium chloride, calcium chloride, calcium nitrate, barium chloride, magnesium chloride, zinc chloride, magnesium sulfate, ammonium sulfate, ammonium hydrogensulfate, sodium hydrogensulfate, aluminum chloride and aluminum sulfate, and an inorganic metallic salt polymer, such as polyaluminum chloride, polyaluminum hydroxide and polycalcium sulfate.

In the invention, an acid may be used upon aggregating the fine particles. Examples of the acid include an inorganic acid, such as hydrochloric acid, nitric acid, sulfuric acid, sulfurous acid and phosphoric acid, and an organic acid, such as acetic acid, acetic anhydride, oxalic acid, citric acid, sulfonic acid monosulfate ester.

In the invention, an organic solvent may be used depending on necessity upon aggregating the fine particles. Examples of the organic solvent include an alcohol, such as methanol, ethanol, 1-propanol, 2-propanol, 2-methyl-2-propanol, 2-methoxyethanol, 2-ethoxyethanol and 2-butoxyethanol, acetonitrile and 1,4-dioxane.

In the invention, for controlling the flowability and the charging property of the toner particles, inorganic fine particles may be added to the surface of the toner particles in an amount of from 0.01 to 20% by weight based on the total weight of the toner. Examples of the inorganic fine particles include silica, titania, alumina, strontium titanate and tin oxide, which may be used solely or as a mixture of two or more of them.

The inorganic fine particles are preferably surface-treated with a hydrophobic agent from the standpoint of improvement in environmental stability. In addition to the inorganic fine particles, resin fine particles having a diameter of 1 μm or less may be added for improving the cleaning property.

Examples of the mixing device for the inorganic fine particles and the like include Henschel Mixer (available from Mitsui Mining Co., Ltd.), Super Mixer (available from Kawata MFG Co., Ltd.), Ribocorn (available from Okawara Corporation), Nauta Mixer (available from Hosokawa Micron Co., Ltd.), Tervurizer (available from Hosokawa Micron Co., Ltd.), Cyclomix (available from Hosokawa Micron Co., Ltd.), Spiralpin Mixer (available from Pacific Machinery & Engineering Co., Ltd.) and Lodige Mixer (available from Matsubo Corporation).

In the invention, coarse particles may be removed by sieving. Examples of a device used for sieving include Ultrasonic (available from Koei Sangyo Co., Ltd.), Gyro Sifter (available from Tokuju Corporation), Vibrasonic System (available from Dalton Corporation), Sonicreen (available from Sintokogyo, Ltd.), Turbo Screener (available from Turbo Kogyo Co., Ltd.), Microshifter (available from Makino MFG Co., Ltd.) and a circular vibration sieve.

The invention will be described in more detail with reference to examples below.

EXAMPLE 1

Production of Colored Fine Particles

Materials having the following formulation for colored fine particles were mixed and then processed with a biaxial kneader set at a temperature of 120° C. to provide a kneaded product. The kneaded product was pulverized with a hammer mill to provide a coarsely granulated mixture.

| Formulation of Colored Fine Particles | |
|---|---|
| Polyester resin (molecular weight: 5,000) | 72 parts by weight |
| Polyester resin (molecular weight: 40,000) | 8 parts by weight |
| Cyan pigment (Pigment Blue 2) | 5 parts by weight |
| Ester wax | 4 parts by weight |
| Charge controlling agent (salicylic acid compound) | 1 part by weight |

40 parts by weight of the coarsely granulated mixture, 0.4 part by weight of an anionic surfactant, 1 part by weight of an amine compound and 58.6 parts by weight of ion exchanged water were placed in a high-pressure microparticulation device, NANO3000, and a finely granulated product was obtained at a number of pass of 1 at a sample temperature increased to 150° C. After completing the process, the temperature was lowered to 30° C. to provide colored fine particles having a volume average particle diameter of 350 nm.

The volume average particle diameter was measured with Coulter Counter (available from Beckman Coulter, Inc.).

The values of molecular weight referred herein are weight average molecular weights measured with Waters 2695, a GPC system available from Waters Corporation.

Production of Resin Fine Particles 40 parts by weight of a polyester resin (molecular weight: 6,000), 0.4 part by weight of an anionic surfactant, 1 part by weight of an amine compound and 58.6 parts by weight of ion exchanged water were placed in NANO3000, and a finely granulated product was obtained at a number of pass of 1 at a sample temperature increased to 150° C. After completing the process, the temperature was lowered to 30° C. to provide resin fine particles having a volume average particle diameter of 100 nm.

Production of Colored Aggregated Material 5 parts by weight of the colored fine particles, 0.2 part by weight of 1N hydrochloric acid and 94.8 parts by weight of ion exchanged water were mixed under agitation at 30° C. Dimethyletnanolamine was added to the mixture with adjustment to pH 6, and the mixture was then heated to 50° C. to provide an aggregated material having a volume average particle diameter of 4.9 μm.

Production of Capsulated Particles 90 parts by weight of the colored aggregated material and 10 parts by weight of the resin fine particles were mixed under agitation at 50° C., and the mixture was heated to 95° C. to provide capsulated particles having a volume average particle diameter of 5.2 μm.

The capsulated particles were washed with a centrifuge until the electroconductivity of the washing water reached 50 μS/cm, and then dried with a vacuum dryer until the water content thereof reached 0.3% by weight to provide toner particles.

After drying, 2 parts by weight of hydrophobic silica and 0.5 part by weight of titanium oxide were attached to the surface of the colored particles to provide a toner. The volume average particle diameter of the toner measured with Coulter Counter (available from Beckman Coulter, Inc.) was 5.2 μm, and the circularity thereof measured with FPIA (available from Sysmex Corporation) was 0.98.

A developing agent was obtained by mixing 5 parts by weight of the capsulated toner and 95 parts by weight of a carrier. The developing agent was evaluated for fixing property with a duplicator for evaluation. The temperature of the fixing device was intentionally changed to measure the temperature range of the fixing device where a favorable image was obtained, and it was found that the temperature range where a favorable image was obtained (non-offset temperature range) was 70° C.

A wider non-offset temperature range is preferred since a favorable image can be obtained against temperature drift of the fixing device. A non-offset temperature range of 50° C. or more can provide an image with no practical problem, and that of 40° C. or less is not preferred since image defects are liable to occur with high probability.

The developing agent was allowed to stand under high temperature and high humidity conditions at 30° C. and 85% for 16 hours, and measured for charge amount q/m(HH) with a suction blow-off device, and the developing agent was allowed to stand under low temperature and low humidity conditions at 10° C. and 20% for 16 hours, and measured for charge amount q/m(LL) with a suction blow-off device to evaluate the charge stability. The charge stability was obtained by subtracting q/m(LL) from q/m(HH), and the developing agent had a charge stability value of 0.75. When the charge stability value is 0.70 or more, a favorable image can be obtained irrespective of environmental atmosphere.

The developing agent was then charged in a duplicator modified for evaluation, and subjected to printing test by printing 100,000 sheets of paper at a printing ratio of 10%. The developing agent after the printing test was collected and measured for the amount of substances that contaminated the surface of the carrier, and the carrier contamination amount was 0.07 part by weight.

The carrier contamination amount is preferably 0.10 part by weight or less for providing a favorable image through printing test of 100,000 sheets of paper.

The results obtained are shown in Table 1.

EXAMPLE 2

Production of Colored Fine Particles

Materials having the following formulation for colored fine particles were mixed and then processed with a biaxial kneader set at a temperature of 120° C. to provide a kneaded product. The kneaded product was pulverized with a hammer mill to provide a coarsely granulated mixture.

| Formulation of Colored Fine Particles | |
|---|---|
| Polyester resin (molecular weight: 6,000) | 72 parts by weight |
| Polyester resin (molecular weight: 40,000) | 8 parts by weight |
| Cyan pigment (Pigment Blue 2) | 5 parts by weight |
| Ester wax | 4 parts by weight |
| Charge controlling agent (salicylic acid compound) | 1 part by weight |

40 parts by weight of the coarsely granulated mixture, 0.4 part by weight of an anionic surfactant, 1 part by weight of sodium hydroxide and 58.6 parts by weight of ion exchanged water were placed in NANO3000, and a finely granulated product was obtained at a number of pass of 1 at a sample temperature increased to 150° C. After completing the process, the temperature was lowered to 30° C. to provide colored fine particles having a volume average particle diameter of 320 nm.

Production of Resin Fine Particles 40 parts by weight of a polyester resin (molecular weight: 6,000), 0.4 part by weight of an anionic surfactant, 1 part by weight of sodium hydroxide and 58.6 parts by weight of ion exchanged water were placed in NANO3000, and a finely granulated product was obtained at a number of pass of 1 at a sample temperature increased to 150° C. After completing the process, the temperature was lowered to 30° C. to provide resin fine particles having a volume average particle diameter of 108 nm.

Production of Colored Aggregated Material 5 parts by weight of the colored fine particles, 0.2 part by weight of 1N hydrochloric acid and 94.8 parts by weight of ion exchanged water were mixed under agitation at 30° C., and the mixture was heated to 50° C. with adjustment of pH to provide an aggregated material having a volume average particle diameter of 4.8 μm.

Production of Capsulated Particles 90 parts by weight of the colored aggregated material and 10 parts by weight of the resin fine particles were mixed under agitation at 50° C., and the mixture was heated to 95° C. to provide capsulated particles having a volume average particle diameter of 5.0 μm.

The capsulated particles were washed with a centrifuge until the electroconductivity of the washing water reached 50 μS/cm, and then dried with a vacuum dryer until the water content thereof reached 0.3% by weight to provide toner particles.

After drying, 2 parts by weight of hydrophobic silica and 0.5 part by weight of titanium oxide were attached to the surface of the colored particles to provide a toner. The volume average particle diameter of the toner measured with Coulter Counter (available from Beckman Coulter, Inc.) was 5.0 μm, and the circularity thereof measured with FPIA (available from Sysmex Corporation) was 0.98.

A developing agent was obtained by mixing 5 parts by weight of the capsulated toner and 95 parts by weight of a carrier. The developing agent was evaluated for fixing property with a duplicator modified for evaluation. The temperature of the fixing device was intentionally changed to measure the temperature range of the fixing device where a favorable image was obtained, and it was found that the temperature range where a favorable image was obtained (non-offset temperature range) was 70° C.

A wider non-offset temperature range is preferred since a favorable image can be obtained against temperature drift of the fixing device. A non-offset temperature range of 50° C. or more can provide an image with no practical problem, and that of 40° C. or less is not preferred since image defects are liable to occur with high probability.

The developing agent was allowed to stand under high temperature and high humidity conditions at 30° C. and 85% for 16 hours, and measured for charge amount q/m(HH) with a suction blow-off device, and the developing agent was allowed to stand under low temperature and low humidity conditions at 10° C. and 20% for 16 hours, and measured for charge amount q/m(LL) with a suction blow-off device to evaluate the charge stability. The charge stability was obtained by subtracting q/m(LL) from q/m(HH), and the developing agent had a charge stability value of 0.76. When the charge stability value is 0.70 or more, a favorable image can be obtained irrespective of environmental atmosphere.

The developing agent was then charged in a duplicator modified for evaluation, and subjected to printing test by printing 100,000 sheets of paper at a printing ratio of 10%. The developing agent after the printing test was collected and measured for the amount of substances that contaminated the surface of the carrier, and the carrier contamination amount was 0.065 part by weight.

The carrier contamination amount is preferably 0.10 part by weight or less for providing a favorable image through printing test of 100,000 sheets of paper.

The results obtained are shown in Table 1.

EXAMPLE 3

Production of Colored Fine Particles

Materials having the following formulation for colored fine particles were mixed and then processed with a biaxial kneader set at a temperature of 120° C. to provide a kneaded product. The kneaded product was pulverized with a hammer mill to provide a coarsely granulated mixture.

| Formulation of Colored Fine Particles | |
|---|---|
| Polyester resin (molecular weight: 6,000) | 72 parts by weight |
| Polyester resin (molecular weight: 40,000) | 8 parts by weight |
| Cyan pigment (Pigment Blue 2) | 5 parts by weight |
| Ester wax | 4 parts by weight |
| Charge controlling agent (salicylic acid compound) | 1 part by weight |

40 parts by weight of the coarsely granulated mixture, 0.4 part by weight of an anionic surfactant, 1 part by weight of an amine compound and 58.6 parts by weight of ion exchanged water were placed in NANO3000, and a finely granulated product was obtained at a number of pass of 1 at a sample temperature increased to 150° C. After completing the process, the temperature was lowered to 30° C. to provide colored fine particles having a volume average particle diameter of 350 nm.

Production of Resin Fine Particles 40 parts by weight of a polyester resin (molecular weight: 6,000), 0.4 part by weight of an anionic surfactant, 1 part by weight of an amine compound and 58.6 parts by weight of ion exchanged water were placed in NANO3000, and a finely granulated product was obtained at a number of pass of 1 at a sample temperature increased to 150° C. After completing the process, the temperature was lowered to 30° C. to provide resin fine particles having a volume average particle diameter of 100 nm.

Production of Colored Aggregated Material 10 parts by weight of the colored fine particles, 1.5 parts by weight of ammonium sulfate and 88.5 parts by weight of ion exchanged water were mixed under agitation at 30° C., and the mixture was heated to 50° C. with adjustment of pH to provide an aggregated material having a volume average particle diameter of 3.2 μm.

Production of Capsulated Particles 85 parts by weight of the colored aggregated material and 15 parts by weight of the resin fine particles were mixed under agitation at 50° C., and the mixture was heated to 93° C. to provide capsulated particles having a volume average particle diameter of 4.5 μm.

The capsulated particles were washed with a centrifuge until the electroconductivity of the washing water reached 50 μS/cm, and then dried with a vacuum dryer until the water content thereof reached 0.3% by weight to provide toner particles.

After drying, 2 parts by weight of hydrophobic silica and 0.5 part by weight of titanium oxide were attached to the surface of the colored particles to provide a toner. The volume average particle diameter of the toner measured with Coulter Counter (available from Beckman Coulter, Inc.) was 4.5 μm, and the circularity thereof measured with FPIA (available from Sysmex Corporation) was 0.96.

A developing agent was obtained by mixing 5 parts by weight of the capsulated toner and 95 parts by weight of a carrier. The developing agent was evaluated for fixing property with a duplicator modified for evaluation. The temperature of the fixing device was intentionally changed to measure the temperature range of the fixing device where a favorable image was obtained, and it was found that the temperature range where a favorable image was obtained (non-offset temperature range) was 75° C.

A wider non-offset temperature range is preferred since a favorable image can be obtained against temperature drift of the fixing device. A non-offset temperature range of 50° C. or more can provide an image with no practical problem, and that of 40° C. or less is not preferred since image defects are liable to occur with high probability.

The developing agent was allowed to stand under high temperature and high humidity conditions at 30° C. and 85% for 16 hours, and measured for charge amount q/m(HH) with a suction blow-off device, and the developing agent was allowed to stand under low temperature and low humidity conditions at 10° C. and 20% for 16 hours, and measured for charge amount q/m(LL) with a suction blow-off device to evaluate the charge stability. The charge stability was obtained by subtracting q/m(LL) from q/m(HH), and the developing agent had a charge stability value of 0.78. When the charge stability value is 0.70 or more, a favorable image can be obtained irrespective of environmental atmosphere.

The developing agent was then charged in a duplicator modified for evaluation, and subjected to printing test by printing 100,000 sheets of paper at a printing ratio of 10%. The developing agent after the printing test was collected and measured for the amount of substances that contaminated the surface of the carrier, and the carrier contamination amount was 0.075 part by weight.

The carrier contamination amount is preferably 0.10 part by weight or less for providing a favorable image through printing test of 100,000 sheets of paper.

The results obtained are shown in Table 1.

EXAMPLE 4

Production of Colored Fine Particles 80 parts by weight of a crystalline polyester resin (melting point: 100° C.), 5 parts by weight of cyan, 4 parts by weight of ester wax and 1 part by weight of a charge controlling agent were mixed and then processed with a biaxial kneader set at a temperature of 120° C. to provide a kneaded product. The kneaded product was pulverized with a hammer mill to provide a coarsely granulated mixture.

40 parts by weight of the coarsely granulated mixture, 0.4 part by weight of an anionic surfactant, 1 part by weight of an amine compound and 58.6 parts by weight of ion exchanged water were placed in NANO3000, and a finely granulated product was obtained at a number of pass of 1 at a sample temperature increased to 150° C. After completing the process, the temperature was lowered to 30° C. to provide colored fine particles having a volume average particle diameter of 350 nm.

Production of Resin Fine Particles 40 parts by weight of an amorphous low molecular weight polyester resin, 0.4 part by weight of an anionic surfactant, 1 part by weight of an amine compound and 58.6 parts by weight of ion exchanged water were placed in NANO3000, and a finely granulated product was obtained at a number of pass of 1 at a sample temperature increased to 150° C. After completing the process, the temperature was lowered to 30° C. to provide resin fine particles having a volume average particle diameter of 100 nm.

Production of Colored Aggregated Material 5 parts by weight of the colored fine particles, 0.2 part by weight of 1N hydrochloric acid and 94.8 parts by weight of ion exchanged water were mixed under agitation at 30° C., and the mixture was heated to 50° C. with adjustment of pH to provide an aggregated material having a volume average particle diameter of 4.7 μm.

Production of Capsulated Particles 90 parts by weight of the colored aggregated material and 10 parts by weight of the resin fine particles were mixed under agitation at 50° C., and the mixture was heated to 90° C. to provide capsulated particles having a volume average particle diameter of 4.9 μm.

The capsulated particles were washed with a centrifuge until the electroconductivity of the washing water reached 50 μS/cm, and then dried with a vacuum dryer until the water content thereof reached 0.3% by weight to provide toner particles.

After drying, 2 parts by weight of hydrophobic silica and 0.5 part by weight of titanium oxide were attached to the surface of the colored particles to provide a toner. The volume average particle diameter of the toner measured with Coulter Counter (available from Beckman Coulter, Inc.) was 4.9 μm, and the circularity thereof measured with FPIA (available from Sysmex Corporation) was 0.95.

A developing agent was obtained by mixing 5 parts by weight of the capsulated toner and 95 parts by weight of a carrier. The developing agent was evaluated for fixing property with a duplicator modified for evaluation. The temperature of the fixing device was intentionally changed to measure the temperature range of the fixing device where a favorable image was obtained, and it was found that the temperature range where a favorable image was obtained (non-offset temperature range) was 70° C.

A wider non-offset temperature range is preferred since a favorable image can be obtained against temperature drift of the fixing device. A non-offset temperature range of 50° C. or more can provide an image with no practical problem, and that of 40° C. or less is not preferred since image defects are liable to occur with high probability.

The developing agent was allowed to stand under high temperature and high humidity conditions at 30° C. and 85% for 16 hours, and measured for charge amount q/m(HH) with a suction blow-off device, and the developing agent was allowed to stand under low temperature and low humidity conditions at 10° C. and 20% for 16 hours, and measured for charge amount q/m(LL) with a suction blow-off device to evaluate the charge stability. The charge stability was obtained by subtracting q/m(LL) from q/m(HH), and the developing agent had a charge stability value of 0.75. When the charge stability value is 0.70 or more, a favorable image can be obtained irrespective of environmental atmosphere.

The developing agent was then charged in a duplicator modified for evaluation, and subjected to printing test by printing 100,000 sheets of paper at a printing ratio of 10%. The developing agent after the printing test was collected and measured for the amount of substances that contaminated the surface of the carrier, and the carrier contamination amount was 0.07 part by weight.

The carrier contamination amount is preferably 0.10 part by weight or less for providing a favorable image through printing test of 100,000 sheets of paper.

The results obtained are shown in Table 1.

COMPARATIVE EXAMPLE 1

Production of Colored Fine Particles

Materials having the following formulation for colored fine particles were mixed and then processed with a biaxial kneader set at a temperature of 120° C. to provide a kneaded product. The kneaded product was pulverized with a hammer mill to provide a coarsely granulated mixture.

| Formulation of Colored Fine Particles | |
|---|---|
| Polyester resin (molecular weight: 6,000) | 72 parts by weight |
| Polyester resin (molecular weight: 40,000) | 8 parts by weight |
| Cyan pigment (Pigment Blue 2) | 5 parts by weight |
| Ester wax | 4 parts by weight |
| Charge controlling agent (salicylic acid compound) | 1 part by weight |

40 parts by weight of the coarsely granulated mixture, 4.0 parts by weight of an anionic surfactant, 1 part by weight of an amine compound and 55 parts by weight of ion exchanged water were placed in Cleamix, which was adjusted to a rotation number of 8,000 rpm. When the sample temperature reached 120° C., the rotation number was changed from 8,000 rpm to 20,000 rpm. After completing the process, the temperature was lowered to 30° C. to provide colored fine particles having a volume average particle diameter of 380 nm.

Production of Resin Fine Particles 8 parts by weight of a polyester resin (molecular weight: 6,000), 4 part by weight of an anionic surfactant, 1 part by weight of an amine compound and 55 parts by weight of ion exchanged water were placed in Cleamix, which was adjusted to a rotation number of 8,000 rpm. When the sample temperature reached 120° C., the rotation number was changed from 8,000 rpm to 20,000 rpm. After completing the process, the temperature was lowered to 30° C. to provide resin fine particles having a volume average particle diameter of 100 nm.

Production of Colored Aggregated Material 5 parts by weight of the colored fine particles, 1 part by weight of aluminum sulfate and 94 parts by weight of ion exchanged water were mixed under agitation at 30° C., and the mixture was heated to 50° C. with adjustment of pH to provide an aggregated material having a volume average particle diameter of 9.5 μm.

Production of Capsulated Particles 85 parts by weight of the colored aggregated material and 15 parts by weight of the resin fine particles were mixed under agitation at 50° C., and the mixture was heated to 95° C. to provide capsulated particles having a volume average particle diameter of 9.6 μm. Fine powder formed due to insufficient aggregation and fusion was observed with an optical microscope.

The capsulated particles were washed with a centrifuge until the electroconductivity of the washing water reached 50 μS/cm, and then dried with a vacuum dryer until the water content thereof reached 0.3% by weight to provide toner particles.

After drying, 2 parts by weight of hydrophobic silica and 0.5 part by weight of titanium oxide were attached to the surface of the colored particles to provide a toner. The volume average particle diameter of the toner measured with Coulter Counter (available from Beckman Coulter, Inc.) was 9.6 μm, and the circularity thereof measured with FPIA (available from Sysmex Corporation) was 0.81.

A developing agent was obtained by mixing 5 parts by weight of the capsulated toner and 95 parts by weight of a carrier. The developing agent was evaluated for fixing property with a duplicator modified for evaluation. The developing agent was not able to be evaluated due to considerable internal contamination with fine powder.

The developing agent was then charged in a duplicator modified for evaluation, and subjected to printing test by printing 100,000 sheets of paper at a printing ratio of 10%. The developing agent after the printing test was collected and measured for the amount of substances that contaminated the surface of the carrier, and the carrier contamination amount was 0.33 part by weight. The carrier contamination amount is preferably 0.10 part by weight or less for providing a favorable image through printing test of 100,000 sheets of paper.

In Comparative Example 1, the aggregated particles were incompletely fused due to the excessive surfactant upon finely granulating in a wet state, and thus the carrier was contaminated.

The results obtained are shown in Table 1.

COMPARATIVE EXAMPLE 2

Production of Colored Fine Particles

Materials having the following formulation for colored fine particles were mixed and then processed with a biaxial kneader set at a temperature of 120° C. to provide a kneaded product. The kneaded product was pulverized with a hammer mill to provide a coarsely granulated mixture.

| Formulation of Colored Fine Particles | |
|---|---|
| Polyester resin (molecular weight: 6,000) | 72 parts by weight |
| Polyester resin (molecular weight: 40,000) | 8 parts by weight |
| Cyan pigment (Pigment Blue 2) | 5 parts by weight |
| Ester wax | 4 parts by weight |
| Charge controlling agent (salicylic acid compound) | 1 part by weight |

40 parts by weight of the coarsely granulated mixture, 0.4 part by weight of an anionic surfactant, 1 part by weight of an amine compound and 58.6 parts by weight of ion exchanged water were placed in NANO3000, and a finely granulated product was obtained at a number of pass of 1 at a sample temperature increased to 150° C. After completing the process, the temperature was lowered to 30° C. to provide colored fine particles having a volume average particle diameter of 350 nm.

Production of Resin Fine Particles 40 parts by weight of a polyester resin (molecular weight: 40,000), 0.4 part by weight of an anionic surfactant, 1 part by weight of an amine compound and 58.6 parts by weight of ion exchanged water were placed in NANO3000, and a finely granulated product was obtained at a number of pass of 1 at a sample temperature increased to 150° C. After completing the process, the temperature was lowered to 30° C. to provide resin fine particles having a volume average particle diameter of 710 nm.

Production of Colored Aggregated Material 5 parts by weight of the colored fine particles, 0.2 part by weight of 1N hydrochloric acid and 94.8 parts by weight of ion exchanged water were mixed under agitation at 30° C., and the mixture was heated to 50° C. with adjustment of pH to provide an aggregated material having a volume average particle diameter of 4.9 μm.

Production of Capsulated Particles 90 parts by weight of the colored aggregated material and 10 parts by weight of the resin fine particles were mixed under agitation at 50° C., and the mixture was heated to 95° C. to provide capsulated particles having a volume average particle diameter of 5.0 μm.

The capsulated particles were washed with a centrifuge until the electroconductivity of the washing water reached 50 μS/cm, and then dried with a vacuum dryer until the water content thereof reached 0.3% by weight to provide toner particles.

After drying, 2 parts by weight of hydrophobic silica and 0.5 part by weight of titanium oxide were attached to the surface of the colored particles to provide a toner. The volume average particle diameter of the toner measured with Coulter Counter (available from Beckman Coulter, Inc.) was 5.2 μm, and the circularity thereof measured with FPIA (available from Sysmex Corporation) was 0.67.

A developing agent was obtained by mixing 5 parts by weight of the capsulated toner and 95 parts by weight of a carrier. The developing agent was evaluated for fixing property with a duplicator modified for evaluation. The developing agent was not able to be evaluated due to considerable internal contamination with fine powder.

The developing agent was then charged in a duplicator modified for evaluation, and subjected to printing test by printing 100,000 sheets of paper at a printing ratio of 10%. The developing agent after the printing test was collected and measured for the amount of substances that contaminated the surface of the carrier, and the carrier contamination amount was 0.48 part by weight. The carrier contamination amount is preferably 0.10 part by weight or less for providing a favorable image through printing test of 100,000 sheets of paper.

In Comparative Example 2, fusing after capsulation was incompletely performed since the resin for the shell had too large a molecular weight.

The results obtained are shown in Table 1.

COMPARATIVE EXAMPLE 3

Production of Colored Fine Particles

Materials having the following formulation for colored fine particles were mixed and then processed with a biaxial kneader set at a temperature of 120° C. to provide a kneaded product. The kneaded product was pulverized with a hammer mill to provide a coarsely granulated mixture.

| Formulation of Colored Fine Particles | |
|---|---|
| Polyester resin (molecular weight: 6,000) | 72 parts by weight |
| Polyester resin (molecular weight: 40,000) | 8 parts by weight |
| Cyan pigment (Pigment Blue 2) | 5 parts by weight |
| Ester wax | 4 parts by weight |
| Charge controlling agent (salicylic acid compound) | 1 part by weight |

40 parts by weight of the coarsely granulated mixture, 0.4 part by weight of an anionic surfactant, 1 part by weight of an amine compound and 58.6 parts by weight of ion exchanged water were placed in NANO3000, and a finely granulated product was obtained at a number of pass of 1 at a sample temperature increased to 150° C. After completing the process, the temperature was lowered to 30° C. to provide colored fine particles having a volume average particle diameter of 350 nm.

Production of Resin Fine Particles 40 parts by weight of a low molecular weight polyester resin, 0.4 part by weight of an anionic surfactant, 1 part by weight of an amine compound and 58.6 parts by weight of ion exchanged water were placed in NANO3000, and a finely granulated product was obtained at a number of pass of 1 at a sample temperature increased to 150° C. After completing the process, the temperature was lowered to 30° C. to provide resin fine particles having a volume average particle diameter of 100 nm.

Production of Colored Aggregated Material 10 parts by weight of the colored fine particles, 2.0 parts by weight of potassium chloride and 88 parts by weight of ion exchanged water were mixed under agitation at 30° C., and the mixture was adjusted to pH 12 and heated to 50° C. to provide an aggregated material having a volume average particle diameter of 2.1 μm.

Production of Capsulated Particles 85 parts by weight of the colored aggregated material and 15 parts by weight of the resin fine particles were mixed under agitation at 50° C., and the mixture was heated at 98° C. for 5 hours to provide capsulated particles having a volume average particle diameter of 4.9 μm.

The capsulated particles were washed with a centrifuge until the electroconductivity of the washing water reached 50 μS/cm, and then dried with a vacuum dryer until the water content thereof reached 0.3% by weight to provide toner particles.

After drying, 2 parts by weight of hydrophobic silica and 0.5 part by weight of titanium oxide were attached to the surface of the colored particles to provide a toner. The volume average particle diameter of the toner measured with Coulter Counter (available from Beckman Coulter, Inc.) was 4.9 μm, and the circularity thereof measured with FPIA (available from Sysmex Corporation) was 0.93.

A developing agent was obtained by mixing 5 parts by weight of the capsulated toner and 95 parts by weight of a carrier. The developing agent was evaluated for fixing property with a duplicator modified for evaluation. The developing agent was not able to be evaluated due to considerable internal contamination with fine powder.

The developing agent was then charged in a duplicator modified for evaluation, and subjected to printing test by printing 100,000 sheets of paper at a printing ratio of 10%. The developing agent after the printing test was collected and measured for the amount of substances that contaminated the surface of the carrier, and the carrier contamination amount was 0.29 part by weight. The carrier contamination amount is preferably 0.10 part by weight or less for providing a favorable image through printing test of 100,000 sheets of paper.

In Comparative Example 3, fusing was incompletely performed since aggregation and capsulation were performed at too high a pH value.

The results obtained are shown in Table 1.

TABLE 1

| | Volume average particle diameter (μm) | Circularity | Non-offset temperature range (° C.) | Charge stability | Carrier contamination amount (% by weight) | Total evaluation |
|---|---|---|---|---|---|---|
| Example 1 | 5.2 | 0.98 | 70 | 0.75 | 0.07 | good |
| Example 2 | 5.0 | 0.98 | 70 | 0.76 | 0.065 | good |
| Example 3 | 4.5 | 0.96 | 75 | 0.78 | 0.075 | good |
| Example 4 | 4.9 | 0.95 | 70 | 0.75 | 0.07 | good |
| Comparative Example 1 | 9.6 | 0.81 | — | — | 0.33 | poor |
| Comparative Example 2 | 5.0 | 0.67 | — | — | 0.48 | poor |
| Comparative Example 3 | 4.9 | 0.93 | — | — | 0.29 | poor |

What is claimed is:

1. A method for producing a developing agent comprising:

melt-kneading a mixture containing a polyester resin, a colorant and a releasing agent to form a kneaded product, coarsely pulverizing the kneaded product to form a coarsely granulated mixture;

mixing the coarsely granulated mixture with an aqueous medium to form a mixed liquid, mechanically shearing the mixed liquid to granulate finely the coarsely granulated mixture, thereby forming a first fine particle dispersion liquid;

aggregating first fine particles in the first fine particle dispersion liquid to form aggregated particles;

mixing coarse particles containing at least a polyester resin with an aqueous medium to form a mixed liquid, mechanically shearing the mixed liquid to granulate finely the coarse particles, thereby forming a second fine particle dispersion liquid; and mixing the second fine particle dispersion liquid with the aggregated particles to aggregate second fine particles in the second fine particle dispersion liquid onto a surface of the aggregated particles, thereby forming capsulated toner particles containing the aggregated particles as a core and the second fine particles as a shell.

2. The method as claimed in claim 1, wherein the first fine particles have a volume average particle diameter of from 50 to 1,000 nm.

3. The method as claimed in claim 1, wherein the second fine particles have a volume average particle diameter of from 50 to 200 nm.

4. The method as claimed in claim 1, wherein the aggregated particles have a volume average particle diameter of from 1 to 15 μm.

5. The method as claimed in claim 1, wherein the aggregated particles have a circularity of from 0.8 to 1.0.

6. The method as claimed in claim 1, wherein the mechanically shearing is performed with a high-pressure microparticulation device.

7. The method as claimed in claim 1, wherein the polyester resin used in the first fine particles includes a first polyester resin, and a second polyester resin having a molecular weight that is different from the molecular weight of the first polyester resin.

* * * * *